US006246854B1

(12) United States Patent
Kurosawa et al.

(10) Patent No.: US 6,246,854 B1
(45) Date of Patent: Jun. 12, 2001

(54) TONER CARTRIDGE AND METHOD USING THE TONER CARTRIDGE FOR FEEDING A PREDETERMINED AMOUNT OF TONER

(75) Inventors: Eiji Kurosawa, Ueda; Takashi Naito, Saku; Katsumi Yawata, Ueda, all of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/497,182

(22) Filed: Feb. 3, 2000

(30) Foreign Application Priority Data

Apr. 6, 1999 (JP) ..... 11-098566

(51) Int. Cl.[7] ..... G03G 15/08
(52) U.S. Cl. ..... 399/263
(58) Field of Search ..... 399/27, 262, 263

(56) References Cited

U.S. PATENT DOCUMENTS 4,733,267 * 3/1988 Enoki et al. ..... 399/27
4,952,976 * 8/1990 Katoh et al. ..... 399/27
5,345,297 * 9/1994 Katakabe et al. ..... 399/263
5,581,334 * 12/1996 Forlani et al. ..... 399/263
6,088,561 * 7/2000 Kawamura et al. ..... 399/263 X
6,115,567 * 9/2000 Kawai et al. ..... 399/263 X

* cited by examiner

*Primary Examiner*—Fred L. Braun
(74) *Attorney, Agent, or Firm*—Greenblum & Bernstein, P.L.C.

(57) ABSTRACT

A toner cartridge is provided that includes an agitator provided in a toner hopper. An agitator gear is coupled with the agitator in such a way that the agitator always has the same positional relationship with the agitator gear. The agitator gear is provided with a mark indicating the orientation of the agitator and an agitation blade fixed thereto. A method of feeding toner using the toner cartridge is also provided, in which the agitator and the agitation blade are withdrawn from the vicinity of a toner feeding hole by turning the agitator gear by hand while watching this mark, and toner is refilled through the toner feeding hole. Feeding toner in this manner enables feeding a predetermined amount of toner.

14 Claims, 4 Drawing Sheets

TONER CARTRIDGE AND METHOD USING THE TONER CARTRIDGE FOR FEEDING A PREDETERMINED AMOUNT OF TONER

BACKGROUND OF THE INVENTION

1. Field of the Invention

The present invention relates to a toner cartridge used for an electrophotographic recording apparatus such as a facsimile apparatus, printer and copier.

2. Description of the Related Art

A conventional electrophotographic recording apparatus uses a toner cartridge comprising a photosensitive medium, charger that charges the surface of the photosensitive medium, toner hopper that contains toner, developing apparatus that provides toner for the surface of the photosensitive medium, waste toner unit that removes and collects the toner remaining on the surface of the photosensitive medium, etc. The toner hopper of the toner cartridge is provided with an agitator furnished with an agitation blade to agitate the toner contained. A shank formed on an end face of the agitator penetrates and sticks out of the sidewall of the toner hopper. The shank is furnished with an agitator gear that engages with a drive gear provided outside the toner hopper to transmit rotation. The sidewall of the toner hopper is provided with a toner feeding hole. When this toner cartridge is used as a refill toner cartridge, toner is fed through this toner feeding hole.

However, when refilling the toner cartridge in this configuration, there are cases where toner hardly enters the toner hopper, causing the problem of the toner hopper failing to be replenished with sufficient toner. The result of an investigation into this problem shows that depending on the stop position of the agitator, the agitator and the agitation blade can sometimes block the toner feeding hole, preventing toner from being fed. To avoid this, the agitator should be stopped at a position that will not block the toner feeding hole. However, since it is difficult to see this agitator from outside, the problem is that the agitator cannot be stopped at a desired position.

SUMMARY OF THE INVENTION

It is an objective of the present invention to provide a toner cartridge that can stop the agitator at a position where the agitator and agitation blade do not block the toner feeding hole.

That is, the present invention affixes to the agitator gear a mark indicating the orientation of the agitator and the agitation blade and makes the agitator gear rotate while maintaining a certain positional relationship between the agitator gear and the agitator. This makes it possible to know the orientation of the agitator and agitation blade by watching the mark of the agitator gear. Therefore, it is possible to turn the agitator gear by hand to withdraw the agitator and agitation blade from the vicinity of the toner feeding hole. This allows trouble-free feeding of toner, preventing manufacturing of any refill toner cartridge with insufficient toner refilling.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Figure 1:
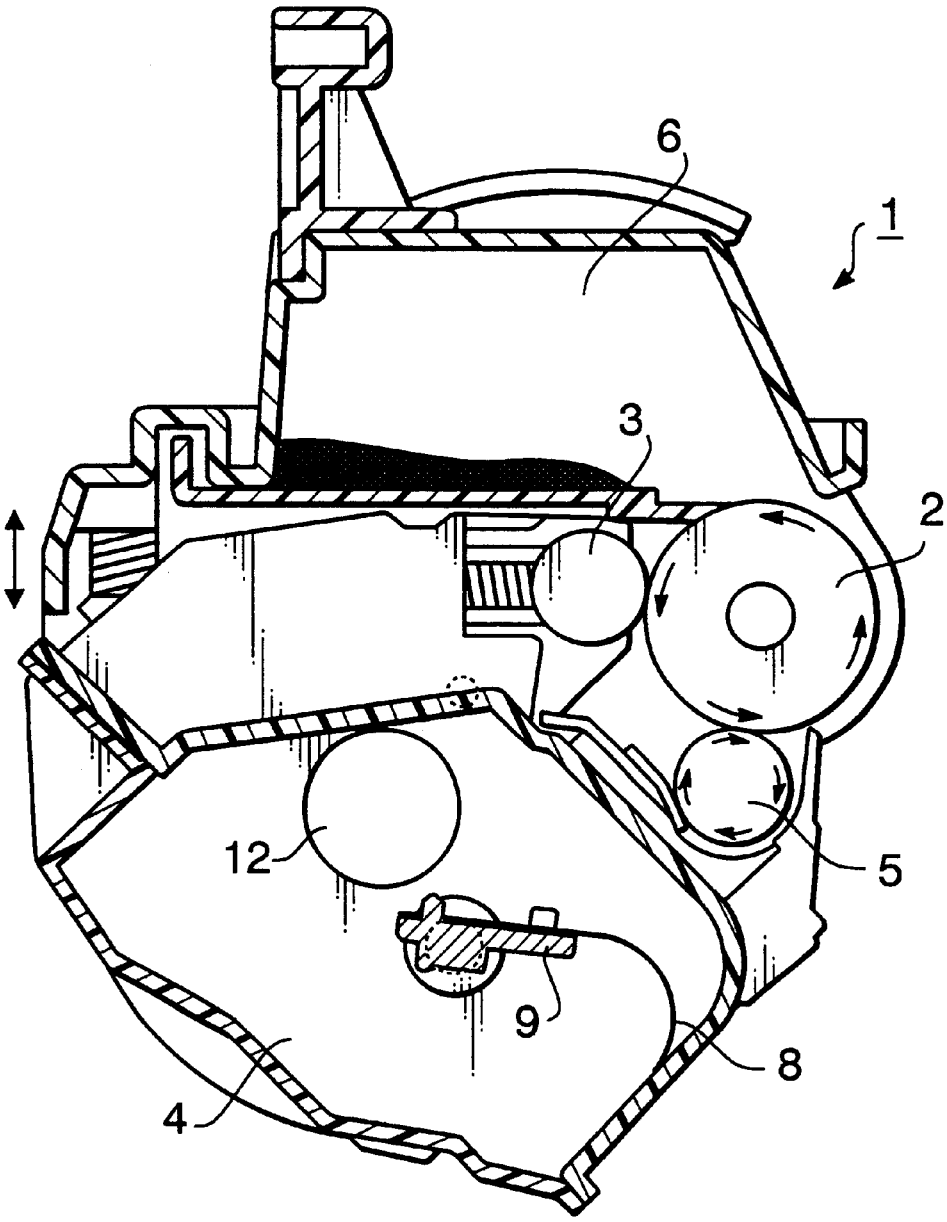
FIG. 1 is an outlined cross-sectional view of a toner cartridge according to an embodiment of the present invention.
Figure 2:
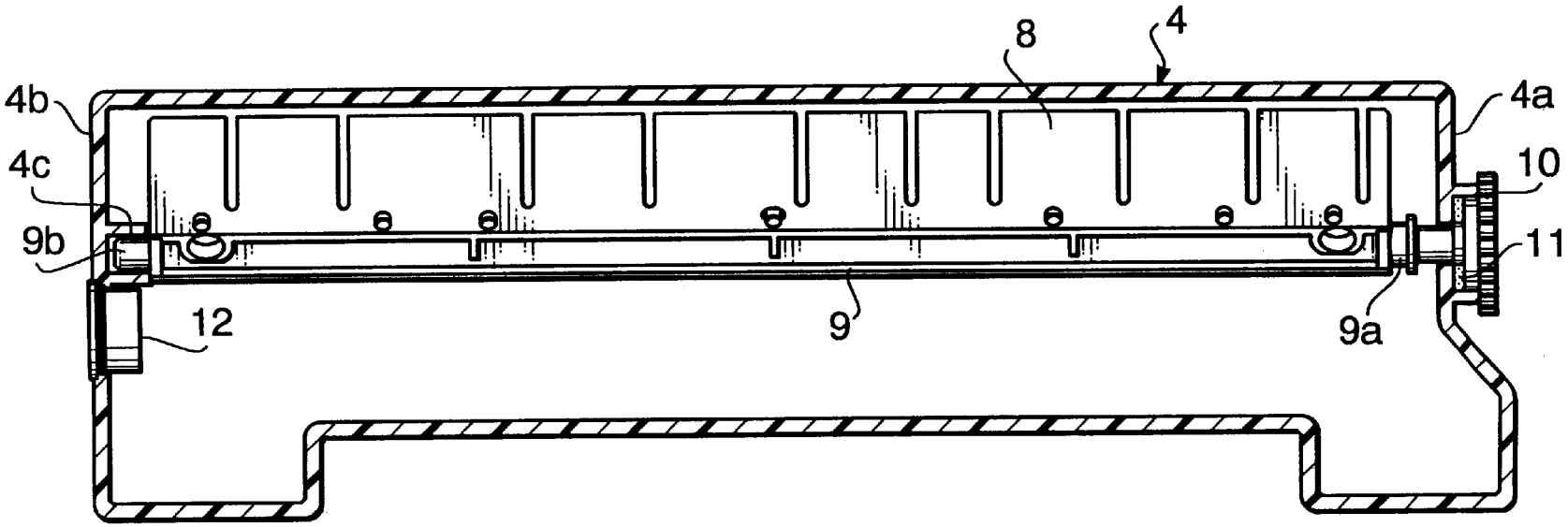
FIG. 2 is an outlined cross-sectional view of a toner hopper of the toner cartridge according to the embodiment above.

With reference now to the attached drawings, the embodiment of the present invention is explained in detail below. FIG. 1 is an outlined cross-sectional view of a toner cartridge according to an embodiment of the present invention. FIG. 2 is an outlined cross-sectional view of a toner hopper of the toner cartridge. In FIG. 1 and FIG. 2, toner cartridge 1 comprises photosensitive medium 2, charger (charging roller) 3 that charges the surface of photosensitive medium 2 uniformly, toner hopper 4 that contains toner, developing apparatus (magnet roller) 5 that provides the surface of photosensitive medium 2 with toner and waste toner unit 6 that removes and collects the toner remaining on the surface of photosensitive medium 2.

Inside toner hopper 4, agitator 9 furnished with film-like agitation blade 8 to agitate toner is provided in a pivotable manner. Agitator gear 10 is connected on one end of agitator 9. Between agitator gear 10 and sidewall 4*a* of toner hopper 4 is toner leakage prevention material 11. On sidewall 4*b* of toner hopper 4 opposite to the side with agitator gear 10 is toner feeding hole 12.

Agitator 9 is formed in the length that fits between the inner sides of sidewalls 4*a* and 4*b* of toner hopper 4. Coupling section 9*a* is provided on the end face of agitator gear 10 and shank 9*b* is provided on the opposite end face. This shank 9*b* is held by bearing 4*c* formed on the inner surface of sidewall 4*b* of toner hopper 4 in a pivotable manner.

Figure 3A:
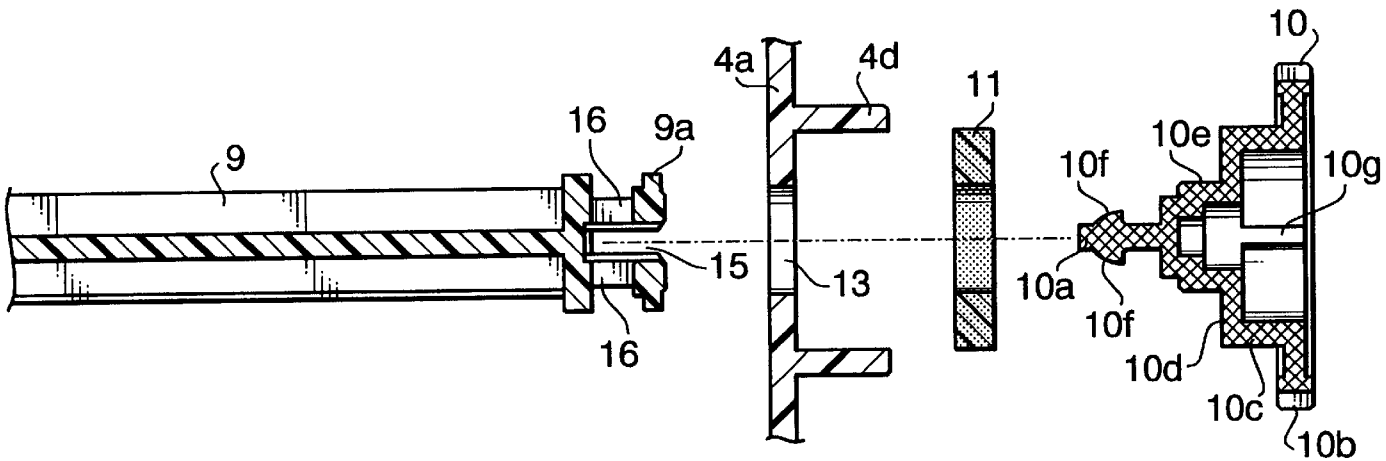
FIG. 3A is an outlined cross-sectional view showing exploded views of the agitator, toner hopper sidewall, toner leakage prevention material and agitator gear of the toner cartridge according to the embodiment above.
Figure 3B:
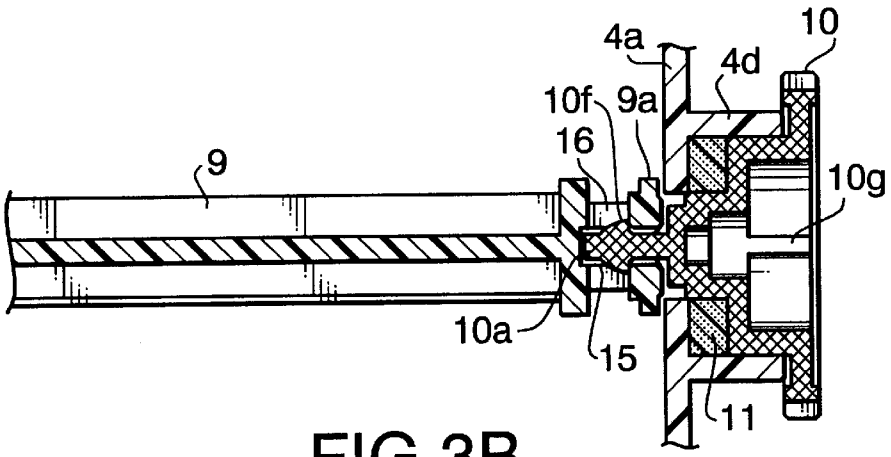
FIG. 3B is an outlined cross-sectional view of the toner cartridge according to the embodiment above when the agitator, toner hopper sidewall, toner leakage prevention material and agitator gear are assembled.
Figure 4A:
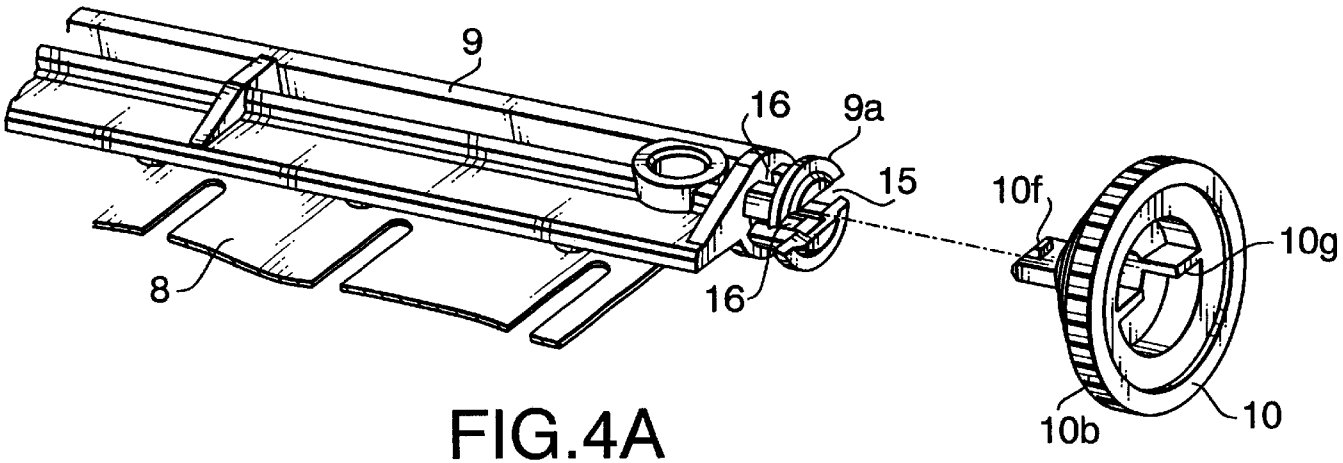
FIG. 4A is an outlined perspective view showing the state of the toner cartridge according to the embodiment above before coupling the agitator and agitator gear.
Figure 4B:
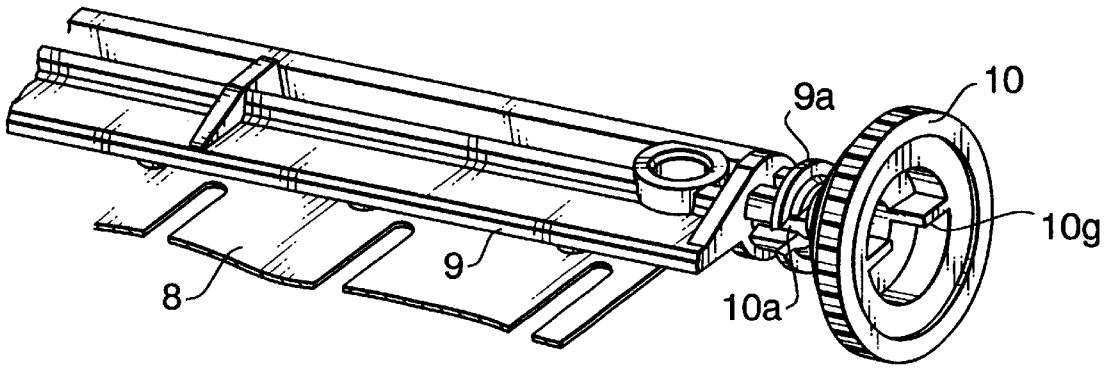
FIG. 4B is an outlined perspective view showing the state of the toner cartridge according to the embodiment above when the agitator and agitator gear are coupled.

Then, the coupling structure between agitator 9 and agitator gear 10 is explained. FIG. 3A is an outlined cross-sectional view of agitator 9, sidewall 4*a* of toner hopper 4, toner leakage prevention material 11 and agitator gear 10 when these are taken apart. FIG. 3B is an outlined cross-sectional view when these are assembled. FIG. 4A is an outlined perspective view showing the state of agitator 9 and agitator gear 10 before these are coupled. FIG. 4B is an outlined perspective view showing their state before they are coupled.

In FIG. 3 and FIG. 4, bearing section 4*d* is formed on the outer surface of sidewall 4*a* of toner hopper 4 to hold agitator gear 10 in a pivotable manner. Hole 13 is formed at the center of sidewall 4*a* to pass coupling section 10*a* of agitator gear 10 to be coupled with agitator 9. Details of coupling section 10*a* of agitator gear 10 will be described later.

Agitator gear 10 comprises gear section 10*b*, cylinder section 10*c* that is held in a pivotable manner by bearing section 4*d* of toner hopper 4, disk section 10*d* that pushes toner leakage prevention material 11 against the outer circumferential surface of hole 13 of sidewall 4*a* of toner hopper 4 and cylinder section 10*e* that supports the inner surface of toner leakage prevention material 11, etc.

Furthermore, at the end of agitator gear 10 is coupling section 10*a* to be coupled with coupling section 9*a* on the end face of agitator 9 through hole 13 formed on sidewall 4*a* of toner hopper 4. This coupling section 10*a* is tabular-shaped and has hooks 10*f* on its two sides.

On the other hand, coupling section 9*a* on the end face of agitator 9 has groove 15 into which coupling section 10*a* can be inserted from the shaft end. Concave section 16 is formed on the two opposed sides of groove 15. This concave section 16 has such a form that allows hooks 10*f* to be inserted and hooked. Hooks 10*f* are tapered from the front end to the rear end so that the hooks are inserted easily into groove 15 and dents are formed at the rear end of the hooks to ensure that the hooks are hooked at the edge of concave section 16.

In this way, pushing tabular coupling section 10*a* of agitator gear 10 into groove 15 of coupling section 9*a* of agitator 9 in the axial direction of agitator 9 allows hooks 10*f* to be inserted into concave section 16 and hooked. This prevents agitator gear 10 from coming off from agitator 9 and secures the coupling for reliable transmission of rotation. Furthermore, since agitator gear 10 is always coupled with agitator 9 in a same positional relationship, agitator gear 10 can rotate while maintaining the same positional relationship with agitator 9.

On the other hand, instead of having tabular coupling section 10*a* of agitator gear 10, it is also possible to configure tabular coupling section 9*a* on the end face of agitator 9 and form groove 15 in coupling section 10*a* of agitator gear 10. It is also possible to form hooks 10*f* on the sides of groove 15 and form concave section 16 on the sides of tabular coupling section 10*a* to insert hooks 10*f*.

As is clear from FIG. 4, mark log which is made up of a rib is formed at a position visible from outside of agitator gear 10. This mark 10*g* is intended to indicate the angle of agitator gear 10. This mark 10*g* is formed in such a way as to match the orientation of tabular coupling section 10*a*. Furthermore, groove 15 on coupling section 9*a* on the end face of agitator 9 is formed in such a way as to have the same orientation as that of agitator 9 and agitation blade 8 attached thereto. Therefore, when agitator gear 10 is coupled with agitator 9, the orientation of mark 10*g* provided in agitator gear 10 matches the orientation of agitator 9 and agitation blade 8. This makes it possible to know the orientation of agitator 9 and agitation blade 8 from this mark 10*g*.

It is desirable that agitator gear 10 be provided in such a way that the rotation angle can be adjusted manually. What is more desirable is to provide agitator gear 10 in such a way that agitator gear 10 can be rotated by turning mark 10*g* made up of the rib by hand. In this case, holding mark 10*g* made up of the rib by hand makes it possible to know the orientation of agitator 9 and agitation blade 8 without watching mark 10*g*.

In the relationship between mark 10*g* made up of the rib and agitation 9 and agitation blade 8, if a certain angle is predetermined, it is possible to know the orientation of agitation 9 and agitation blade 8 from this mark 10*g*. However, it is desirable to match the orientation of mark 10*g* made up of the rib with the orientation of agitation 9 and agitation blade 8 as in the case of the present embodiment. In this case, it is easier to know the orientation of agitation 9 and agitation blade 8 than when the orientation of mark 10*g* made up of the rib does not match the orientation of agitation 9 and agitation blade 8.

Here, mark 10*g* made up of the rib is provided in agitator gear 10, but mark 10*g* need not necessarily be a rib or provided in agitator gear 10. That is, mark 10*g* an have any shape or can be provided anywhere if mark 10*g* can at least indicate the orientation of agitator 9 and agitation blade 8.

Toner leakage prevention material 11 is intended to prevent toner from leaking, and sponge, etc. is usually used. For agitator gear 10, resin with strength and abrasion resistance necessary for the gear is used and polyacetal is an example of this. Agitator 9 does not require abrasion resistance so much, and therefore economical general-purpose resin is used.

As is clear from FIG. 3, toner leakage prevention material 11 is pushed against sidewall 4*a* by agitator gear 10. Therefore, when agitator 9 and agitator gear 10 rotate, agitator gear 10 slides on toner leakage prevention material 11. Since abrasion-resistant resin is used for agitator gear 10, agitator gear 10 is free of any problem with abrasion originated by toner leakage prevention material 11.

In the case of the conventional configuration with the shank provided on the end face of agitator 9 sticking out of hole 13 of sidewall 4*a* and agitator gear 10 attached to the shank, toner leakage prevention material 11 must be held by the shank of agitator 9. This often causes the shank to wear during sliding. Preventing this abrasion will require a countermeasure such as attaching an abrasion-resistant sleeve to the shank, which will increase the number of parts. However, the toner cartridge of the present embodiment can solve this problem.

With toner cartridge 1 in such a configuration, when agitator 9 and agitator gear 10, etc. are incorporated in toner hopper 4, agitator 9 is placed in toner hopper 4. Then, shank 9*b* on one end of agitator 9 is inserted into bearing section 4*c* of the inner surface of sidewall 4*b* of toner hopper 4. Then, coupling section 9*a* on the other end is held at a position opposed to hole 13 of sidewall 4*a* of toner hopper 4. Then, while holding toner leakage prevention material 11 on cylindrical surface 10*e* of agitator gear 10 from outside, agitator gear 10 is inserted into bearing section 4*b*. Coupling section 10*a* at the end of agitator gear 10 is then inserted into groove 15 of coupling section 9*a* of agitator 9 through hole 13. This makes hooks 10*f* engage with concave section 16, ensuring the coupling between agitator 9 and agitator gear 10. The operation above provides an extremely simple way of assembly.

When refilling this toner cartridge 1, that is, when refilling toner hopper 4 with toner, it is possible to withdraw agitator 9 and agitation blade 8 from toner feeding hole 12 as shown in FIG. 1 by turning agitator gear 10 by hand while watching mark 10*g* of agitator gear 10 outside toner hopper 4. Then, feeding toner through toner feeding hole 12 allows toner feeding to be performed without being blocked by agitator 9 and agitation blade 8, assuring speedy feeding of a predetermined quantity of toner.

As explained above, the present invention has a configuration providing the agitator gear with a mark to indicate the orientation of the agitator and the agitation blade and maintaining the same positional relationship between the agitator gear and agitator when the agitator gear rotates, and in this way the present invention makes it possible to turn the agitator gear by hand while watching the mark of the agitator gear to withdraw the agitator and agitation blade from the vicinity of the toner feeding hole. This allows toner feeding to be performed without being blocked by the agitator and agitation blade, making it possible to feed a predetermined amount of toner speedily and securely.

The present invention has such a configuration that the coupling section on the end face of the agitator to be coupled with the agitator gear is placed in the inner side of the sidewall of the toner hopper and the agitator gear is held in a pivotable manner by the bearing section formed on the sidewall of the toner hopper and the coupling section of the agitator gear penetrates through the hole in the sidewall of the toner hopper and is coupled with the coupling section on the end face of the agitator. Furthermore, the present invention has such a configuration that the agitator gear pushes the toner leakage prevention material against the outer circumferential surface of the hole in the sidewall of the toner hopper. This simplifies the coupling structure between the agitator and agitator gear and the toner leakage prevention structure. This makes it easy to place the agitator in the toner hopper and couple the agitator with the agitator gear, etc. Moreover, since it is the agitator gear that slides on the toner leakage prevention material, the agitator gear hardly wears.

The present invention also has a configuration that either one of the coupling section on the end face of the agitator or the coupling section of the agitator gear is formed in a tabular shape and the other is furnished with a groove into which the tabular coupling section is inserted. Furthermore, present invention provides hooks for either one of the side of the tabular coupling section or the opposed side with the groove, and a concave section into which the hooks are inserted and hooked for the other. In this way, the tabular coupling section can be inserted into the groove of the other coupling section and connected thereto by simply pushing in the agitator gear toward the end face of the agitator. This makes it possible not only to couple the agitator and agitator gear through an extremely simple operation but also to always couple the agitator and agitator gear in the same positional relationship.

The present invention is not limited to the above described embodiments, and various variations and modifications may be possible without departing from the scope of the present invention.

This application is based on the Japanese Patent Application No.HEI11-98566 filed on Apr. 6, 1999, entire content of which is expressly incorporated by reference herein.

What is claimed is:

1. A toner cartridge attachable to a recording apparatus in a detachable manner, comprising:

a toner hopper fixed to a frame of said toner cartridge, said toner hopper having a toner feeding hole in a sidewall;

an agitator provided with at least one agitation blade that rotates in said toner hopper and agitates said toner, said agitation blade blocking and unblocking said toner feeding hole in accordance with rotation of said agitation blade;

an agitator gear coupled with said agitator to transmit rotation from an external drive gear to said agitator; and a mark indicating the orientation of said agitator and said agitation blade so as to indicate whether the agitation blade is blocking the toner feeding hole while toner is fed through said toner feeding hole.

2. The toner cartridge according to claim 1, wherein said agitator gear comprises said mark at an externally visible position and rotates when transmitting rotation from said external drive gear to said agitator while maintaining its positional relationship with said agitator.

3. The toner cartridge according to claim 2, wherein said agitator gear can manually adjust the rotation angle.

4. The toner cartridge according to claim 3, wherein said mark is made up of a tabular rib.

5. The toner cartridge according to claim 4, wherein the plane of said tabular rib is provided substantially parallel to the plane of said agitator and said agitation blade.

6. The toner cartridge according to claim 1, wherein said agitator comprises a coupling section that, when mounted in said toner hopper, is positioned inwardly with respect to a sidewall of said toner hopper, and said agitator gear comprising:

a cylinder section pivotably held by a bearing section formed on an outer surface of the sidewall of said toner hopper; and a coupling section that penetrates through a hole formed in the sidewall of said toner hopper and is coupled with the coupling section of said agitator.

7. The toner cartridge according to claim 6, further comprising a material positioned between a sidewall of said toner hopper and said agitator gear to prevent toner from leaking, wherein said agitator gear comprises a disk section that pushes said material against the outer circumferential surface of a hole formed in the sidewall of said toner hopper.

8. The toner cartridge according to claim 7, wherein the coupling section of said agitator gear is formed in a tabular shape and the coupling section of said agitator is provided with a groove into which the coupling section of said agitator gear can be inserted.

9. The toner cartridge according to claim 8, wherein hooks are formed in the coupling section of said agitator gear and a concave section is formed to insert and hook said hooks in the groove into which the coupling section of said agitator gear can be inserted.

10. The toner cartridge according to claim 6, wherein the coupling section of said agitator gear is formed in a tabular shape and the coupling section of said agitator is provided with a groove into which the coupling section of said agitator gear can be inserted.

11. The toner cartridge according to claim 10, wherein hooks are formed in the coupling section of said agitator gear and a concave section is formed to insert and hook said hooks in the groove into which the coupling section of said agitator gear can be inserted.

12. The toner cartridge according to claim 1, wherein the at least one agitation blade is a single agitation blade.

13. A recording apparatus comprising the toner cartridge according to claim 1.

14. A toner refilling method that refills a toner cartridge with toner including a toner hopper fixed to a frame of the toner cartridge for containing the toner, an agitator provided with an agitation blade that rotates in the toner hopper and agitates the toner, an agitator gear coupled with the agitator to transmit rotation from an external drive gear to the agitator, and a mark indicating an orientation of the agitator and the agitation blade, the method comprising:

withdrawing said agitator and said agitation blade from the vicinity of a toner feeding hole formed on a sidewall of said toner hopper based on said mark; and refilling the toner hopper with toner through said toner feeding hole.

* * * * *